US006506991B1

(12) United States Patent
Eixelberger et al.

(10) Patent No.: US 6,506,991 B1
(45) Date of Patent: Jan. 14, 2003

(54) METHOD AND APPARATUS FOR SORTING WASTE PAPER OF DIFFERENT GRADES AND CONDITIONS

(75) Inventors: Rainer Eixelberger, Gleisdorf (AT); Peter Friedl, Graz (AT); Karlheinz Gschweitl, Grosspesendorf (AT)

(73) Assignee: Binder & Co. Aktiengesellschaft, Gleisdorf (AT)

( * ) Notice: Subject to any disclaimer, the term of this patent is extended or adjusted under 35 U.S.C. 154(b) by 0 days.

(21) Appl. No.: 09/559,634

(22) Filed: Apr. 28, 2000

(30) Foreign Application Priority Data

Apr. 30, 1999 (AU) ..... 300/99

(51) Int. Cl.[7] ..... B07C 5/342

(52) U.S. Cl. ..... 209/581; 209/587; 209/639; 209/932

(58) Field of Search ..... 209/576, 577, 209/580, 581, 582, 587, 589, 639, 643, 644, 932, 938, 939

(56) References Cited

U.S. PATENT DOCUMENTS

| | | | | | |
|---|---|---|---|---|---|
| 4,909,930 | A | * | 3/1990 | Cole | 209/587 X |
| 5,242,059 | A | * | 9/1993 | Low et al. | 209/643 X |
| 5,318,173 | A | * | 6/1994 | Datari | 209/580 |
| 5,333,739 | A | | 8/1994 | Stelte | 209/587 X |
| 5,423,431 | A | * | 6/1995 | Westin | 209/587 X |
| 5,520,290 | A | * | 5/1996 | Kumar et al. | 209/587 X |
| 5,632,381 | A | | 5/1997 | Thust et al. | 209/590 X |
| 5,813,543 | A | * | 9/1998 | Gesing et al. | 207/587 X |
| 5,955,741 | A | * | 9/1999 | Kayami | 209/587 X |

FOREIGN PATENT DOCUMENTS

| | | | | |
|---|---|---|---|---|
| AU | 001959 | | 2/1998 | |
| DE | 3926641 | | 2/1991 | |
| DE | 4135394 | | 4/1993 | |
| DE | 4345106 | | 6/1995 | |
| EP | 0873795 | | 10/1998 | |
| EP | 0873797 | | 10/1998 | |
| WO | 86/03613 | * | 6/1986 | 209/589 |

OTHER PUBLICATIONS

English Language Abstract of EP 0 873 797.

Abstract of EP 0 873 797.

* cited by examiner

*Primary Examiner*—Tuan N. Nguyen
(74) *Attorney, Agent, or Firm*—Greenblum & Bernstein, P.L.C.

(57) ABSTRACT

Method and apparatus for sorting waste paper pieces of different grades and conditions. The method includes moving a plurality of waste paper pieces in a conveying direction on at least one sorting belt, each waste paper piece having a surface, irradiating at least one area of the surface with radiation, registering the radiation reflected from the surface, and sorting the waste paper on the basis of the reflected radiation, wherein waste paper pieces of at least one type are separated from waste paper pieces of at least one other type. The apparatus includes at least one sorting belt for conveying a plurality of waste paper pieces in a conveying direction, at least one radiation source arranged above the sorting belt for irradiating at least one area of the sorting belt, at least one evaluation device which registers the radiation reflected from the pieces of waste paper, and at least one sorting device arranged downstream from the at least one radiation source, wherein waste paper pieces of at least one type are separated from waste paper pieces of at least one other type using the at least one sorting device and on the basis of outputs from the evaluation device.

41 Claims, 1 Drawing Sheet

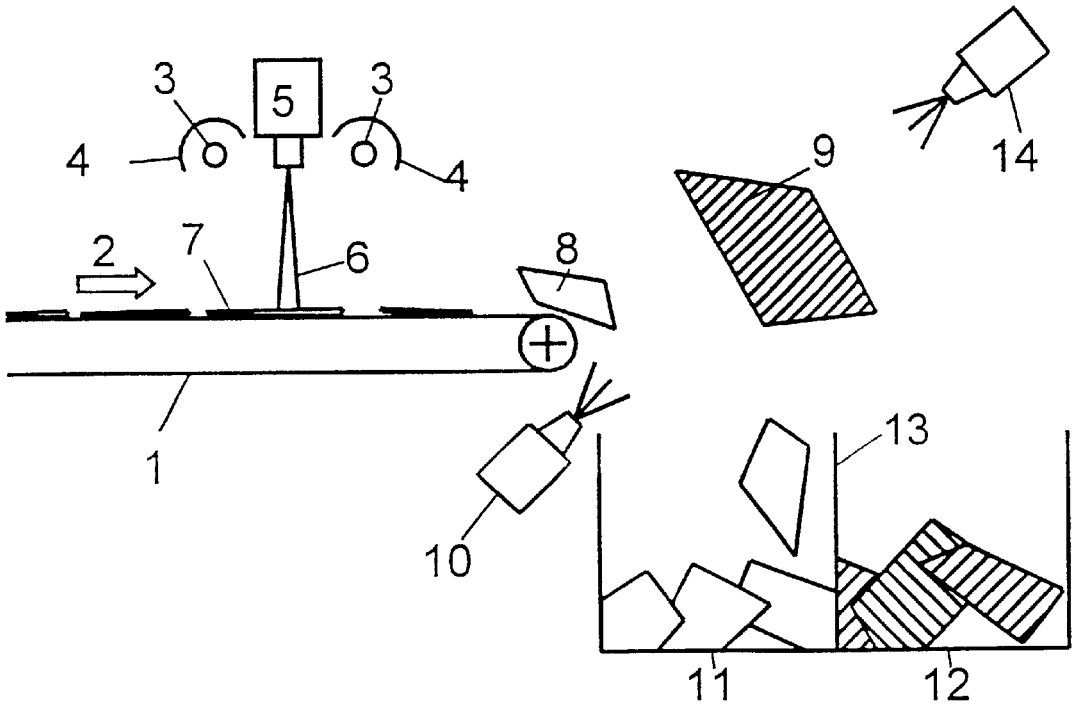
3
5
3
4
4
2
7
6
8
9
14
1
10
13
11
12

METHOD AND APPARATUS FOR SORTING WASTE PAPER OF DIFFERENT GRADES AND CONDITIONS

CROSS-REFERENCE TO RELATED APPLICATIONS

The present application claims priority under 35 U.S.C. § 119 of Austrian Patent Application No. GM 300/99, filed on Apr. 30, 1999, the disclosure of which is expressly incorporated by reference herein in its entirety.

BACKGROUND OF THE INVENTION

1. Field of the Invention

The invention relates to a method of sorting waste paper of different grades and conditions, in which at least one area of the surface of various waste paper fractions or pieces, such as paper and board, which are lying on at least one sorting belt, is irradiated such that the radiation reflected from the pieces of waste paper is registered. Thereafter, the pieces of waste paper are assigned to a specific waste paper fraction on the basis of the data which is determined from the reflected radiation. The pieces are subsequently sorted appropriately based upon this data. The invention also relates to an apparatus which practices this method.

2. Discussion of Background Information

A known method and apparatus are disclosed by the Registered Design specification AT 001 959 U1, application number GM 246/97, and this document is expressly incorporated by reference it its entirety. According to AT 001 959 U1, the fractions or pieces are separated on a sorting belt. Moreover, the pieces are irradiated by radiation sources, such as a light source. Additionally, the reflected radiation is registered by evaluation units and the pieces of waste paper are thereafter assigned to a specific fraction which is picked up by pick-up devices and thereafter deposited on a predetermined deposit location.

In this conventional method, the reflected radiation is picked up by a camera and the specific features, e.g., the different wavelengths of the reflected radiation, of the area picked up are compared with stored classifiers which can be learned. However, this conventional method and apparatus cannot efficiently and adequately sort paper fractions. Additionally, it has a relatively high error rate in separating the types fractions.

SUMMARY OF THE INVENTION

The invention therefore provides a system with a low sorting error rate and provides a quick, simple method and a corresponding apparatus for sorting waste paper efficiently.

The invention takes advantage of the intensity differences of the radiation which is reflected from adjacent subareas of the area viewed. These intensity differences are accordingly determined. Moreover, by using the intensity distribution inherent to each waste paper fraction, better assignment to a specific fraction can be achieved in utilizing the invention.

One aspect of the invention provides that each of the equally large subareas is assigned an intensity value. Then, the relative difference between the intensity values of adjacent subareas is determined and the sum of these intensity differences is formed for the area viewed. For example, a narrow rectangular strip may be imaged and subdivided into equally large squares, which are also referred to as pixels. Each pixel is accordingly assigned a specific intensity value. Then, for each pair of pixels, most particularly adjacent pixels, the difference in the intensity values is formed or determined. Thereafter, all the differences are subsequently summed.

In this case, provision can be made for the pieces of waste paper to be assigned to a paper fraction if the sum of the intensity differences exceeds a limiting value or threshold. Thus, for the area viewed, if high intensity differences occur between the pixels, that is say, for example, a light/dark change occurs frequently, it can be assumed that this piece is one having close printing (e.g., small text). As a result of these light/dark differences, the sum of the intensity differences will be correspondingly large.

It should be noted that the limiting value for the paper fraction may be made adjustable. Moreover, this limiting value may be established beforehand. Alternatively, it may be established empirically by conducting numerous trials.

In a similar way, provision may be made for the pieces of waste paper to be assigned to the board fraction. In this case, the sum of the intensity differences will generally fall at or below a limiting value. This is because board generally has very little if any printing for the area viewed. Accordingly, with little or no intensity differences occurring between adjacent pixels, the sum of the intensity differences will be correspondingly small. Again, as described above, the limiting value may be made adjustable and/or determined by trial and error.

For the purpose of separating two distinct fractions, e.g., paper and board, the two aforementioned limiting values may coincide.

According to the invention, an area is advantageously irradiated with visible light. This allows for the use of standard radiation sources and standard evaluation devices which are commercially available. As a result, this design can be made cost-effective. However, infrared radiation may also be utilized with frequencies in the close infrared, e.g., having a range which includes wavelengths from approximately 780 nanometers to approximately 2,000 nanometers. Moreover, radiation in the X-ray range may also be utilized.

A further refinement of the method provides that the method of sorting is additionally used in which the wavelength of the reflected radiation is taken into account. By utilizing a combination of the method according to the invention with the method shown in AT 001 959 U1, the accuracy of the sorting can be increased still further.

In this case, for example, the procedure is such that firstly, using the method in which the wavelength of the reflected radiation is determined, an attempt is made to assign the piece of waste paper to a specific fraction. This is the part of the combination which utilizes the system disclosed in AT 001 959 U1. However, in the event that a piece of waste paper cannot be assigned uniquely to a specific fraction, use may be subsequently made of the method of sorting in which the intensity differences in the reflected radiation are determined. This is the part of the combination which utilizes the features of the invention. By combining these systems, it is possible to take full advantage of the benefits of the two methods. In particular, this combination makes it possible for pieces of waste paper which, according to the method of AT 001 959 U1 could be both paper and board (such as specific newsprint, whose color is similar to that of board) to be assigned uniquely.

The invention utilizes a system or apparatus for implementing the method of sorting waste paper of different grade and conditions. Moreover, this apparatus processes various waste paper fractions, such as paper and board.

The apparatus includes at least one sorting belt for conveying the pieces of waste paper lying thereon. Above the sorting belt there is arranged at least one radiation source, for irradiating at least one area of the sorting belt, and at least one evaluation device. The evaluation device registers the radiation reflected from the pieces of waste paper of the individual fractions and assigns the pieces of waste paper to a specific waste paper fraction on the basis of the data determined. Moreover, the radiation source and the evaluation device have at least one sorting device arranged downstream in the conveying direction of the sorting belt. The apparatus provides that at least one part of an evaluation device, which determines intensity differences of the radiation which is reflected from adjacent subareas of the area viewed, is arranged above the sorting belt.

In a simple and cost effective embodiment of the invention, the radiation source radiates visible light. In this case, provision may be made for the evaluation device to utilize a camera.

Additionally, the method according to the invention may be executed quickly and with little outlay with regard to data processing, if the evaluation device utilizes a line-scan type camera. This device can be utilized to scan a narrow strip of the area of interest. In this design, the intensity differences may be determined for only a series of subareas.

In one embodiment, the sorting device utilizes at least one device for producing a flow of air. This design allows for the waste paper fraction to be sorted out without mechanical pick-up devices which tend to wear out over time. Moreover, these air flow devices may be designed as blowing devices. These may take the form of pressure nozzles, and/or in particular compressed-air nozzles. Alternatively, these devices may be suction devices, such as vacuum nozzles, fans or pumps. Furthermore, the system may utilize a combination of blowing devices and suction devices in order to effect more efficient sorting.

Using such sorting devices, the pieces of waste paper which are identified by the evaluation device as board can, for example, be lifted or guided specifically by compressed air and/or by vacuum at the end of the sorting belt. Accordingly, they are conveyed by this air flow over the top edge of a separating edge arranged downstream of the sorting belt (as viewed in the direction of motion of the sorting belt), behind which edge they fall to the bottom. In contrast, the remaining fractions, for example the paper fraction, may be allowed to simply fall to the bottom directly after the sorting belt into a separate area. Of course, even in this embodiment, the system may operate to separate and move the paper fraction with air flow while allowing the board fraction to fall off the end of the sorting belt.

According to another embodiment, the sorting device utilizing the blowing devices and/or suction devices is replaced with one or more pick-up devices, such as mechanical gripping tongs, suckers, clamping rolls, needle grippers or electrostatic other conventional pick-up devices. These devices may be of the design and arrangement of the sorting devices which are described in AT 001 959 U1. Of course, the invention also contemplates a combination of air flow sorting devices and mechanical pick-up devices. Moreover, these may operate together in conjunction with and/or in side by side fashion, or in a manner where they are spaced apart and operate independently of one another.

In addition, it may be advantageous if the radiation source itself emits radiation in at least one sub-range of the frequency range from infrared to X-rays. Additionally, the evaluation device may advantageously be designed to evaluate the wavelength of the reflected radiation. In this way, a combination of two sorting methods, namely a method in which the wavelength of the reflected radiation is determined, and the method of sorting according to the invention, in which the intensity differences of the reflected radiation are determined, can be achieved in a simple way.

Alternatively, provision can be made for at least one further radiation source, which emits radiation in at least one sub-range of the frequency range from infrared to X-rays, and at least one additional evaluation device, which evaluates the wavelength of the reflected radiation, to be provided. In this design, it is possible for at least one dedicated radiation source and evaluation device also to be provided in each case for each of the two sorting methods. This may become necessary when the wavelengths of the radiation needed for the respective method differ too sharply from one another.

The present invention is directed to a method of sorting waste paper pieces of different grades and conditions. The method includes moving a plurality of waste paper pieces in a conveying direction on at least one sorting belt, in which each waste paper piece has a surface, irradiating at least one area of the surface with radiation, registering the radiation reflected from the surface, and sorting the waste paper on the basis of the reflected radiation. Waste paper pieces of at least one type are separated from waste paper pieces of at least one other type.

According to a feature of the invention, the method can further include determining intensity differences of the radiation which is reflected from adjacent subareas of the area of the surface.

In accordance with another feature of the present invention, at least some of the plurality of waste paper pieces can include one of paper and board.

The method can also include assigning equally large subareas of the surface being irradiated an intensity value, such that a relative difference between the intensity values of adjacent subareas is determined. Further, the process can include determining a sum of the intensity differences for a particular area. Still further, the process may include comparing the sum of the intensity differences to a limiting value. The comparing can include determining if the sum exceeds the limiting value. Further, the comparing can include determining if the sum is less than or equal to the limiting value. Moreover, determining the sum can include identifying a waste paper piece as a board fraction.

According to still another feature of the instant invention, the radiation may include one of visible light radiation, infrared radiation, and X-ray radiation.

In accordance with a further feature of the invention, the method can include registering determining wavelengths of the reflected radiation to facilitate sorting. The wavelengths of the reflected radiation may be determined for a particular waster paper piece. Further, the process can include attempting to classify the particular waste paper piece as a specific paper type using the wavelengths, such that if the particular piece of paper is not so classified, then intensity differences in the reflected radiation are determined.

The present invention is directed to an apparatus for sorting waste paper pieces of different grades and conditions. The apparatus includes at least one sorting belt for conveying a plurality of waste paper pieces in a conveying direction, at least one radiation source arranged above the sorting belt for irradiating at least one area of the sorting belt, at least one evaluation device which registers the radiation reflected from the pieces of waste paper, and at least one sorting device arranged downstream from the at least one radiation source. Waste paper pieces of at least one type are separated from waste paper pieces of at least one other type using the at least one sorting device and on the basis of outputs from the evaluation device.

According to a feature of the present invention, the at least one evaluation device can include a processor.

In accordance with a feature of the invention, the processor can determine intensity differences of the radiation which is reflected from adjacent subareas of an area subjected to radiation.

According to another feature of the invention, the at least one evaluation device may be arranged above the sorting belt.

Further, in accordance with the instant invention, the at least one sorting device may be arranged downstream from the sorting belt in the conveying direction.

In accordance with still another feature of the present invention, the at least one radiation source may radiate one of visible light, infrared, and X-rays.

Moreover, the evaluation device can include a camera. The camera may include a line-scan camera.

Still further, the at least one sorting device may include at least one device for producing a flow of air. The at least one device for producing a flow of air may include one of a blowing device and a vacuum device. Further, the at least one device for producing a flow of air may include a blowing device in the form of at least one pressure nozzle. The pressure nozzle may include a compressed-air nozzle.

The at least one device for producing a flow of air can include a suction device in the form of at least one vacuum nozzle.

Further, the at least one device for producing a flow of air may include one of a fan and a pump.

According to a further feature of the instant invention, the at least one sorting device may include at least one pick-up device. The at least one pick-up device can include one of mechanical gripping tongs, a sucker device, a clamping roll, a needle gripper, and an electrostatic pick-up device.

In accordance with a still further feature of the present invention, the at least one radiation source can radiate a radiation in at least one sub-range of the frequency range from infrared to X-rays.

According to yet another feature of the invention, the at least one evaluation device can be adapted to evaluate the wavelength of the reflected radiation.

Moreover, the at least one radiation source can include an additional radiation source, such that the additional radiation source radiates radiation in at least one sub-range of the frequency range from infrared to X-rays. The at least one evaluation device can include an additional evaluation device, such that the additional evaluation device is adapted to evaluate the wavelength of the reflected radiation.

The present invention is directed to a method of sorting waste paper pieces of different grades and conditions. The method includes moving a plurality of waste paper pieces in a conveying direction on at least one sorting belt, where the pieces of waste paper include at least one surface which can reflect some amount of radiation. The method further includes irradiating the at least one surface of at least one waste paper piece while the at least one piece is moving on the sorting belt, registering radiation which is reflected from the at least one surface, and determining an intensity difference of the radiation which is reflected from adjacent subareas of the at least one surface. Still further, the process includes comparing the intensity difference to a limiting value and separating the at least one waste paper piece from remaining waste paper pieces on the basis of the comparing. Waste paper pieces of at least one type are separated from waste paper pieces of at least one other type.

In accordance with a feature of the invention, the separating can include moving the at least one piece of waste paper using directed air flow.

According to another feature of the present invention, the separating may include moving the at least one piece of waste paper to a deposit location using directed air flow.

The instant invention is directed to a system for sorting waste paper pieces of different grades and conditions wherein the waste paper pieces include at least one surface which can reflect some amount of radiation. The system includes at least one conveyor belt for moving a plurality of waste paper pieces in a conveying direction, at least one radiation source for irradiating the at least one surface of at least one waste paper piece while the at least one waste paper piece is moving on the belt, and at least one camera coupled to at least one processor for determining an intensity difference of the radiation which is reflected from adjacent subareas of the at least one surface. The system also includes at least one device for comparing the intensity difference to a limiting value and at least one device for separating the at least one waste paper piece from a remainder of waste paper pieces on the basis of the comparing. Waste paper pieces of at least one type are continuously separated from waste paper pieces of at least one other type.

In accordance with a feature of the present invention, the at least one device for separating may include at least one device for producing an air flow path which can direct the movement of the at least one piece to a specific deposit location.

According to another feature of the present invention, the at least one device for producing an air flow may include one of pressure nozzles and suction nozzles.

Further, in accordance with still another feature of the instant invention, the at least one device for separating can receive inputs from the at least one device for comparing. The at least one device for comparing may include a second processor which is coupled to a first processor, the first processor being coupled to the camera.

In accordance with still another feature of the invention, the at least one camera can include a line-scan camera.

Further, the at least one radiation source can radiate one of visible light, infrared, and X-rays.

Other exemplary embodiments and advantages of the present invention may be ascertained by reviewing the present disclosure and the accompanying drawing.

BRIEF DESCRIPTION OF THE DRAWINGS

The present invention is further described in the detailed description which follows, in reference to the noted plurality of drawings by way of non-limiting examples of embodiments of the present invention, in which like reference numerals represent similar parts throughout the several views of the drawings, and wherein:

The sole FIGURE shows a schematic representation of a side view of an apparatus according to the invention.

DETAILED DESCRIPTION OF THE INVENTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

Waste paper fractions 7 are deposited, fed, or otherwise put onto a sorting belt 1, which can be moved in a conveying direction 2. Sorting belt 1 may be subdivided into a number of tracks which run parallel to the conveying direction 2. Arranged above sorting belt 1 is a module which contains at least one light source 3 having an associated reflector 4 and a camera 5. Camera 5 is designed as a line-scan camera which images a strip or area whose length corresponds approximately to a width of sorting belt 1 so that it covers all the tracks. This width, represented by the imaging region 6, may be on the order of magnitude of approximately a few millimeters. Arranged in camera 5 is a processor unit, which evaluates the data scanned by camera 5 and controls an associated sorting device.

The invention also contemplates having a number of modules arranged above sorting belt 1, for example, with each module being placed behind one another when viewed in the plane of the drawing (transverse to the conveying direction). Moreover, each module may contain a number of light sources 3 and an associated reflector 4 and camera 5. Preferably, one module is provided for each track. Additionally, these modules may be formed as a group of modules such that cameras 5, in each case, image a strip which corresponds approximately to the width of one track. Further, each camera 5 may either itself contain a processor unit or alternatively, all cameras 5 may be connected or coupled to a central processor unit, with which they form an evaluation device.

In operation, waste paper fractions 7 are irradiated under camera 5 with light or radiation from light or radiation sources 3. The reflected light is then picked up by camera 5 in accordance with imaging area 6. Since camera 5 is designed as a line-scan camera, it supplies an image which consists of a series of pixels, with each pixel having a specific lightness or intensity, for example a specific grey value. The image data is then forwarded to the processor unit. The central processor unit then evaluates and determines the precise position of the piece of waste paper. In the processor unit, for each pair of pixels, the difference between the intensity values is determined. Thereafter, the sum of all the differences of an image is determined such that an appropriate assignment to the paper or board fraction is carried out.

The processor unit, which may be in the respective camera, or the central processor unit is designed to store the position of the pieces of waste paper assigned to a specific fraction, as well as to control the sorting device appropriately. A preferred processor is a cascadeable signal processor with real time processing, whereas performance can be enhanced by connecting the processors in series. Moreover, the processors function with inputs or input data from the camera(s) and produces outputs or output data in the form of signals which are used to direct and control the pressure nozzles/vacuum nozzles. The interaction between the sorting device or devices and the processor is such that nozzles 10 and 14 of the sorting device are being controlled based upon the camera data, whereas the time delay is computed in accordance with the velocity of sorting belt 1.

As described above, camera 5 may utilize a camera processor which evaluates the camera data. Moreover, an additional processor may be connected or coupled, e.g., in series, to the camera processor, such that this additional processor controls sorting belt 1 and sorting device, i.e., nozzles 10 and 14. Further, in such a design, the camera processor may be a digital signal processor.

The invention may also utilize algorithms such as color detection algorithms and/or algorithms for detecting the distribution of intensity, i.e., brightness.

The sorting device may essentially comprise pressure nozzles 10, such as compressed-air nozzles, which are arranged at the end of sorting belt 1. These may be mounted at an acute angle to the plane of sorting belt 1 and underneath it. For each track on sorting belt 1, at least one pressure nozzle 10 may be provided. In addition to, or instead of, pressure nozzles 10, at least one vacuum nozzle 14 can be arranged in an approximately opposite position so that the nozzle takes in air and thus reinforcing the lifting action of pressure nozzle 10. Of course, instead of vacuum nozzles 14, other suction devices, such as fans or vacuum pumps, can also be used.

In operation, the sorting device produces an air current which carries the waste paper piece to the correct deposit location or area, which may be a container. This curtain may be precisely defined by utilizing the appropriate combination of pressure nozzle(s) 10 and/or vacuum nozzle(s) 14. Moreover, each of pressure nozzle(s) 10 and/or vacuum nozzle(s) 14 are preferably moveable (e.g., pivotal, rotatable, translatable, etc.) and/or adjustable so as to precisely direct, control, or define the air flow direction and/or path. Additionally, it is preferred that the pressure in the nozzle(s) be made adjustable as well. A pressure of between approximately 2–7 bar in excess of atmospheric pressure has been found to work well.

In a system where board is to be removed or separated from paper, the system may provide that a piece of waste paper 8 identified as paper (instead of board, for example) reaches the end of sorting belt 1. That is, the paper fractions may be allowed to remain on sorting belt 1 such that they are not subjected to a supply of air from pressure nozzles 10, and further no suction action is provided by vacuum nozzles 14 to try and move them. Accordingly, the pieces of paper 8 will be allowed to fall down past the end of sorting belt 1 into a deposit location designed to retain the paper. This deposit location is preferably a paper container 11. If, on the other hand, a piece of waste paper 9 is identified as board and this board reaches the end of sorting belt 1, the system activates the compressed air which is fed through the pressure nozzles 10 and/or vacuum is produced by vacuum nozzles 14 in order to cause the movement of the board to a separate deposit location.

The sorting devices are preferably all controlled by the (central) processor unit. Preferably, each sorting device is separately controlled for each individual track, such that each piece of board 9 is not allowed to fall immediately at the end of sorting belt 1 like the paper. Instead, because of the force exerted by the air flow on the board, these pieces are carried further in conveying direction 2 of sorting belt 1 to a location which may be over separating edge 13 wherein they are allowed to fall into a separate deposit location or area. This deposit location is preferably designed as a board container 12.

It should be noted that the invention contemplates that each deposit location or area may itself utilize a conveyor belt or similar material handling device instead of being a mere container or static deposit location. Such a design would allow for a continuous sorting process and would not have the disadvantage of requiring that the containers be emptied on a regular basis.

Another embodiment for separating paper and board provides that the positions of carton or board container 12 and paper container 11, as well as the positions of pressure nozzles 10 and vacuum nozzles 14 are exchanged or switched. That is, board container 12 may be closer to sorting belt 1 than paper container 11 and the positions of pressure nozzles 10 and vacuum nozzles 14 switched so that vacuum nozzle 14 is near the end of sorting belt 1.

In the embodiment which is shown in the drawing, if a piece of waste paper 8 is identified as paper reaches the end of sorting belt 1, no air is supplied by pressure nozzles 10, nor is any suction action produced by vacuum nozzles 14, such that the piece of paper 8 is allowed to fall down. In this case, the movement of the paper will essentially follow a parabolic trajectory, into paper container 11.

However, in the embodiment described above wherein the nozzles and containers are switched, if a piece of waste paper 9 is identified as board, then when it reaches the end of the sorting belt 1, compressed air is fed from above by pressure nozzles 10 and/or a vacuum is produced by vacuum nozzles 14, so that the piece of board 9 is immediately moved downwards because of the force exerted and collected in board container 12, which directly follows sorting belt 1.

It should be noted here that the invention also contemplates the use of only blowing devices or only vacuum devices as well as a combination of such these. In particular, the arrangement of such devices may be precisely matched to separate paper from board, board from paper, or both paper and board which is mixed with other things. Preferably, the blowing/suction action is expediently carried out only for the fraction with the lower proportion, e.g, for a mixture of board and paper fractions wherein roughly 20% is board and 80% is paper, it is both preferable and more efficient to utilize the nozzles to move the board instead of the more numerous paper fractions. It goes without saying that the deposit locations should be arranged appropriately with respect to the sorting belt 1 and nozzles 10 and 14. Of course, as described above, both fractions (paper and board) can also be picked up by suction and/or blown out so as to be properly separated from one another.

Sorting belt 1 is preferably moved continuously, so that the movement can be utilized to continuously separate the pieces of board 9 and the pieces of paper 8.

Further embodiments of the invention emerge from a combination of the apparatus shown in AT 001 959 U1 and the method shown therein, in combination with the invention.

In this case, when viewed in the direction of motion of the sorting belt 1, a further group of modules can be arranged above sorting belt 1. These may be positioned upstream of the group of modules according to the invention. Moreover, each of these may comprise a number of light sources 3 having an associated reflector 4 and a camera 5. Additionally, a module in each case may have a number of radiation sources and a camera which registers the different wavelengths of the reflected radiation. In this way, firstly an assignment of the pieces of waste paper using the wavelengths of the reflected radiation can be carried out, and subsequently an assignment on the basis of the intensity differences of the reflected radiation. This is particularly advantageous when the assignment is often not unequivocal after the first method.

If both methods or apparatuses operate with radiation of equal wavelengths, then both can be executed with a group of modules, a module having a camera for each method, for example, or a camera for both, and the same radiation sources for both methods.

Of course, if more than two fractions are to be separated, it is possible to utilize a number of groups of modules. These can perform an assignment on the basis of the wavelengths of the reflected radiation and can be arranged one behind another in the conveying direction of the sorting belt. If appropriate, a sorting device may be provided directly after each group of modules in order to sort out at least one fraction. This sorting device can utilize various pick-up devices or combinations thereof, such as suckers (if appropriate in combination with a pair of clamping rolls), gripping tongs, needle grippers or electrostatic pick-up devices, so that the fraction which is being sorted out is moved by the pick-up devices to a predetermined deposit location or to a further conveyor belt.

As discussed above, the board fraction can be sorted out either with the aid of the above-mentioned mechanical sorting device as well, or with a sorting device which contains devices for producing a flow of air, and/or a combination of these.

Each camera 5 of a module may have a processor unit itself or one or more cameras may be connected to a central processor unit. In the case of a central processor, the modules of one group may utilize a common central processor unit. Additionally, it is also possible for a number of groups to have a common central processor unit, and if appropriate, a further or additional processor unit. One function of the processing unit is to activate the appropriate pick-up device or the compressed-air nozzles of the individual sorting devices at the given time on the basis of the data which is determined.

The invention represents an advancement for separating waste paper, in particular board and paper, over the conventional separation methods, which have proven inadequate in the classification of pieces of waste paper.

It is noted that the foregoing examples have been provided merely for the purpose of explanation and are in no way to be construed as limiting of the present invention. While the present invention has been described with reference to an exemplary embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

What is claimed:

1. A method of sorting waste paper pieces of different grades and conditions, the method comprising:

moving a plurality of waste paper pieces in a conveying direction on at least one sorting belt, each waste paper piece having a surface;

irradiating at least one area of the surface with radiation;

registering the radiation reflected from the surface;

determining intensity differences of the radiation which is reflected from adjacent subareas of the area of the surface of a waste paper piece;

determining a sum of the intensity differences for a particular area of the waste paper piece; and sorting the waste paper on the basis of the sum of the intensity differences, wherein waste paper pieces of at least one type are separated from waste paper pieces of at least one other type.

2. The method of claim 1, wherein at least some of the plurality of waste paper pieces comprise one of paper and board.

3. The method of claim 1, further comprising:

assigning equally large subareas of the surface being irradiated an intensity value, such that a relative difference between the intensity values of adjacent subareas is determined.

4. The method of claim 1, further comprising:

comparing the sum of the intensity differences to a limiting value.

5. The method of claim 4, wherein the comparing comprises determining if the sum exceeds the limiting value.

6. The method of claim 4, wherein the comparing comprises determining if the sum is less than or equal to the limiting value.

7. The method of claim 6, wherein determining the sum further comprises identifying a waste paper piece as a board fraction.

8. The method of claim 1, wherein the radiation comprises one of visible light radiation, infrared radiation, and X-ray radiation.

9. The method of claim 1, wherein registering further comprises determining wavelengths of the reflected radiation to facilitate sorting.

10. The method of claim 9, wherein the wavelengths of the reflected radiation are determined for a particular waster paper piece.

11. The method of claim 10, further comprising:

attempting to classify the particular waste paper piece as a specific paper type using the wavelengths, such that if the particular piece of paper is not so classified, then intensity differences in the reflected radiation are determined.

12. An apparatus for sorting waste paper pieces of different grades and conditions, comprising:

at least one sorting belt for conveying a plurality of waste paper pieces in a conveying direction;

at least one radiation source arranged above the sorting belt for irradiating at least one area of the sorting belt;

at least one evaluation device which registers the radiation reflected from the pieces of waste paper; and at least one sorting device arranged downstream from the at least one radiation source, wherein waste paper pieces of at least one type are separated from waste paper pieces of at least one other type using the at least one sorting device and on the basis of outputs from the evaluation device, wherein the at least one evaluation device comprises a processor, wherein the processor determines intensity differences of the radiation which is reflected from adjacent subareas of an area subjected to radiation, and wherein the at least one evaluation device determines a sum of the intensity differences for a particular area of a waste paper piece.

13. The apparatus of claim 12, wherein the at least one evaluation device is arranged above the sorting belt.

14. The apparatus of claim 12, wherein the at least one sorting device is arranged downstream from the sorting belt in the conveying direction.

15. The apparatus of claim 12, wherein the at least one radiation source radiates one of visible light, infrared, and X-rays.

16. The apparatus of claim 12, wherein the evaluation device comprises a camera.

17. The apparatus of claim 16, wherein the camera comprises a line-scan camera.

18. The apparatus of claim 12, wherein the at least one sorting device comprises at least one device for producing a flow of air.

19. The apparatus of claim 18, wherein the at least one device for producing a flow of air comprises one of a blowing device and a vacuum device.

20. The apparatus of claim 18, wherein the at least one device for producing a flow of air comprises a blowing device in the form of at least one pressure nozzle.

21. The apparatus of claim 20, wherein the pressure nozzle comprises a compressed-air nozzle.

22. The apparatus of claim 18, wherein the at least one device for producing a flow of air comprises a suction device in the form of at least one vacuum nozzle.

23. The apparatus of claim 18, wherein the at least one device for producing a flow of air comprises one of a fan and a pump.

24. The apparatus of claim 12, wherein the at least one sorting device comprises at least one pick-up device.

25. The apparatus of claim 24, wherein the at least one pick-up device comprises one of mechanical gripping tongs, a sucker device, a clamping roll, a needle gripper, and an electrostatic pick-up device.

26. The apparatus of claim 12, wherein the at least one radiation source radiates a radiation in at least one sub-range of the frequency range from infrared to X-rays.

27. The apparatus of claim 12, wherein the at least one evaluation device is adapted to evaluate the wavelength of the reflected radiation.

28. The apparatus of claim 12, wherein the at least one radiation source comprises an additional radiation source, such that the additional radiation source radiates radiation in at least one sub-range of the frequency range from infrared to X-rays.

29. The apparatus of claim 28, wherein the at least one evaluation device comprises an additional evaluation device, such that the additional evaluation device is adapted to evaluate the wavelength of the reflected radiation.

30. A method of sorting waste paper pieces of different grades and conditions, the method comprising:

moving a plurality of waste paper pieces in a conveying direction on at least one sorting belt, the pieces of waste paper comprising at least one surface which can reflect some amount of radiation;

irradiating the at least one surface of at least one waste paper piece while the at least one piece is moving on the sorting belt;

registering radiation which is reflected from the at least one surface;

determining an intensity difference of the radiation which is reflected from adjacent subareas of the at least one surface;

determining a sum of the intensity differences for a particular area of the waste paper piece;

comparing the sum of the intensity difference to a limiting value; and separating the at least one waste paper piece from remaining waste paper pieces on the basis of the comparing, wherein waste paper pieces of at least one type are separated from waste paper pieces of at least one other type.

31. The method of claim 30, wherein the separating comprises moving the at least one piece of waste paper using directed air flow.

32. The method of claim 30, wherein the separating comprises moving the at least one piece of waste paper to a deposit location using directed air flow.

33. A system for sorting waste paper pieces of different grades and conditions wherein the waste paper pieces comprise at least one surface which can reflect some amount of radiation, the system comprising:

at least one conveyor belt for moving a plurality of waste paper pieces in a conveying direction;

at least one radiation source for irradiating the at least one surface of at least one waste paper piece while the at least one waste paper piece is moving on the belt;

at least one camera coupled to at least one processor for determining an intensity difference of the radiation which is reflected from adjacent subareas of the at least one surface;

at least one device for determining a sum of the intensity differences for a particular area and for comparing the sum of the intensity difference to a limiting value; and at least one device for separating the at least one waste paper piece from a remainder of waste paper pieces on the basis of the comparing, wherein waste paper pieces of at least one type are continuously separated from waste paper pieces of at least one other type.

34. The system of claim 33, wherein the at least one device for separating comprises at least one device for producing an air flow path which can direct the movement of the at least one piece to a specific deposit location.

35. The system of claim 33, wherein the at least one device for producing an air flow comprises one of pressure nozzles and suction nozzles.

36. The system of claim 33, wherein the at least one device for separating receives inputs from the at least one device for comparing.

37. The system of claim 36, wherein the at least one device for determining and comparing comprises a second processor which is coupled to a first processor, the first processor being coupled to the camera.

38. The system of claim 33, wherein the at least one camera comprises a line-scan camera.

39. The system of claim 33, wherein the at least one radiation source radiates one of visible light, infrared, and X-rays.

40. An apparatus for sorting waste paper pieces of different grades and conditions, comprising:

at least one sorting belt for conveying a plurality of waste paper pieces in a conveying direction;

at least one radiation source arranged above the at least one sorting belt for irradiating at least one area of the at least one sorting belt;

at least one evaluation device which registers the radiation reflected from the pieces of waste paper; and at least one sorting device arranged downstream from the at least one radiation source, wherein waste paper pieces of at least one type are separated from waste paper pieces of at least one other type using the at least one sorting device and on the basis of outputs from the at least one evaluation device, wherein the at least one sorting device comprises at least one device for producing a flow of air, and wherein the at least one device for producing a flow of air comprises one of a blowing device and a vacuum device.

41. A system for sorting waste paper pieces of different grades and conditions wherein the waste paper pieces comprise at least one surface which can reflect some amount of radiation, the system comprising:

at least one conveyor belt for moving a plurality of waste paper pieces in a conveying direction;

at least one radiation source for irradiating the at least one surface of at least one waste paper piece while the at least one waste paper piece is moving on the at least one conveyor belt;

at least one camera coupled to at least one processor for determining an intensity difference of the radiation which is reflected from adjacent subareas of the at least one surface;

at least one device for comparing the intensity difference to a limiting value; and at least one device for separating the at least one waste paper piece from a remainder of waste paper pieces on the basis of the comparing, wherein waste paper pieces of at least one type are continuously separated from waste paper pieces of at least one other type, and wherein the at least one device for producing an air flow comprises one of pressure nozzles and suction nozzles.

* * * * *